United States Patent [19]

Zernow

[11] 4,312,274

[45] Jan. 26, 1982

[54] METHOD FOR SELECTING WARHEAD FRAGMENT SIZE

[75] Inventor: Louis Zernow, Glendora, Calif.

[73] Assignee: Whittaker Corporation, Los Angeles, Calif.

[21] Appl. No.: 759,945

[22] Filed: Jan. 17, 1977

[51] Int. Cl.[3] ..... F42B 13/48

[52] U.S. Cl. ..... 102/493; 102/495; 102/506

[58] Field of Search ..... 102/64, 67, 493, 495, 102/506

[56] References Cited

U.S. PATENT DOCUMENTS 3,820,464 6/1974 Dixon ..... 102/67

FOREIGN PATENT DOCUMENTS 1142716 2/1969 United Kingdom ..... 102/67

*Primary Examiner*—Peter A. Nelson

*Attorney, Agent, or Firm*—Donald E. Nist

[57] ABSTRACT

Warhead fragment size can be selectively controlled by: (1) internally or externally grooving a warhead casing; (2) providing an internal casing liner or explosive charge with a predetermined cutting groove pattern confronting the grooves in the casing; (3) positioning the liner or explosive charge groove pattern relative to the casing groove pattern so that warhead fragments of one size will be produced if the grooves in the liner or explosive charge are rendered ineffective for cutting the warhead and so that fragments of another size will be produced if the grooves in the linear or explosive charge are not rendered ineffective and therefore are utilized to cut the casing; (4) providing apparatus in the warhead for delivering a fluid such as water to the grooves in the linear or explosive charge to selectively inhibit the cutting action of those grooves to provide desired warhead fragment size(s). Fluid delivery can be effected before warhead flight or it can be effected during flight by remote control to provide warhead fragment sizes adjusted to the "hardness" or "softness" of a designated target.

In one embodiment, the groove pattern in the liner or explosive charge is fixed relative to the groove pattern in the warhead casing. In another embodiment, the groove pattern in the liner or explosive charge is movable with respect to the groove pattern in the casing with movement performed before or during warhead flight.

16 Claims, 9 Drawing Figures

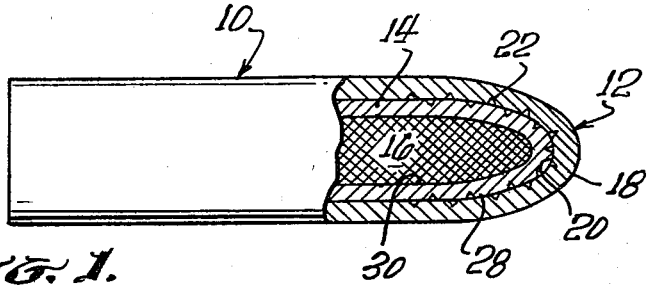
FIG. 1.
FIG. 2.
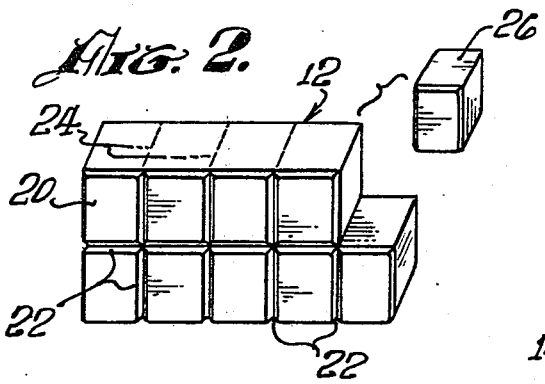
FIG. 3.
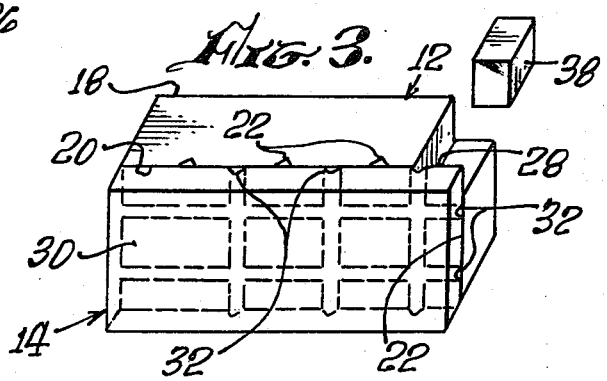
FIG. 4.
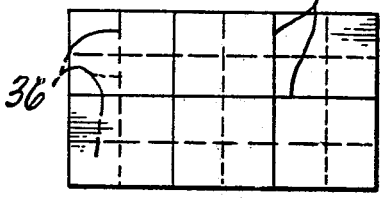
FIG. 5a.
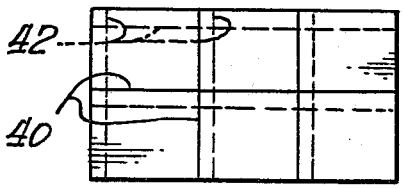
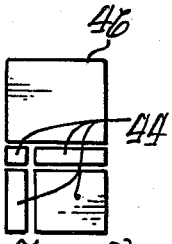
FIG. 5b.
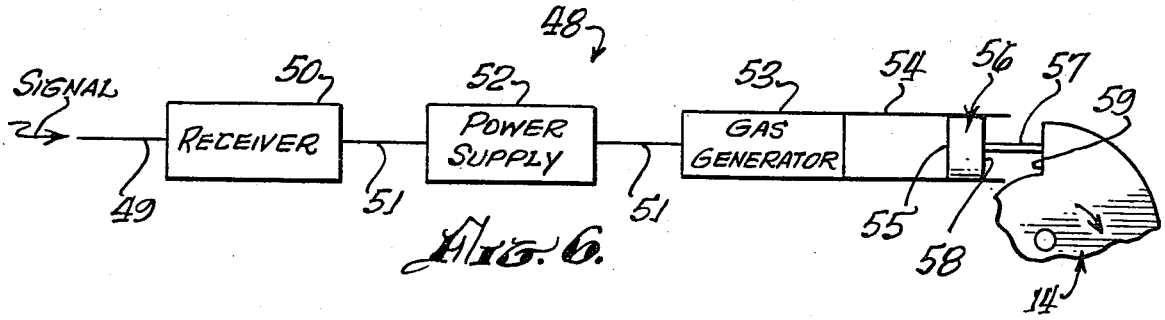
FIG. 6.

METHOD FOR SELECTING WARHEAD FRAGMENT SIZE

BACKGROUND OF THE INVENTION

The invention relates to warhead technology and, more specifically, to methods for controlling the size of warhead fragments.

Warheads may be directed against a wide spectrum of targets. On one end of the spectrum, there are "soft" targets which can include personnel or aircraft parked in the open. On the other end of the spectrum, there are "hard" targets which may include anti-aircraft gun emplacements and tanks. Between these two extremes, there are a multitude of targets.

One of the factors determining whether a particular warhead will be effective against a particular target is the size (mass) of the fragments produced upon detonation of the explosive within the warhead. In general, the softer the target, the smaller the fragments can be.

Warhead fragment size can be predetermined. This has been done by either pre-grooving the interior surface of the warhead casing (the Pearson pre-groove system) or by pre-grooving the casing-confronting surfaces of the explosive charge or of a sheet of metal which functions as an inner liner for the metal casing. When the casing alone is grooved, the casing groove pattern determines the fragment size. On the other hand, when both the casing and the liner or explosive charge are grooved, the resulting groove pattern combination determines the fragment size.

A problem with the aforementioned techniques is that they cannot be varried after the groove pattern is set. Thus, for example, if the fragment sizes are chosen for soft targets and a new hard target appears, the effectiveness of the warhead will be reduced if it has initially been set for a soft target (and vice versa). This invention overcomes this disadvantage.

SUMMARY OF THE INVENTION

This invention comprises a method and means for selectively inhibiting the cutting action of a groove pattern cut into the surface of an interior warhead casing liner or explosive charge which confronts a grooved interior casing surface. The means includes apparatus having the capability of delivering a fluid, upon command, to the grooves in the liner or explosive charge so that, when the cutting action of the liner or explosive charge is inhibited, the fragment size is determined by the groove pattern of the casing, but when the cutting action of those grooves is not inhibited, the warhead fragment size is determined by the combined groove patterns of the casing and liner or explosive charge.

In one embodiment, the liner or explosive charge groove pattern is fixed in position with respect to the casing groove pattern whereas, in a second embodiment, the liner or explosive charge groove pattern is movable with respect to the casing pattern.

In either embodiment, fragment sizes can be selected either prior to launch or during warhead flight by inhibiting or not inhibiting the cutting action of the liner or explosive charge grooves. However, in the second embodiment, a greater selection of fragment sizes is possible because the two groove patterns can be moved with respect to each other either prior to launch or in flight. Thus, fragment size can be more readily tailored to the "hardness" or "softness" of a designated target using the herein-described invention as compared with the prior art.

DESCRIPTION OF THE DRAWINGS

FIG. 1 is a partially sectioned, side elevational view of a warhead incorporating the herein-described invention and shows a grooved metal liner disposed between a grooved warhead casing and the explosive charge.

FIG. 2 is a perspective view of a section of the warhead casing of FIG. 1 showing a fragment produced therefrom.

FIG. 3 is a perspective view of the casing section shown in FIG. 2 together with the corresponding section of metal liner and shows a fragment which may be produced from this combination.

FIG. 4 is a diagrammatic representation in plan view of the superposed casing/liner combination of FIG. 3 illustrating one alignment of the grooves in the casing and liner.

FIG. 5(*a*) is a diagrammatic representation in plan view of the superposed casing/liner combination of FIG. 3 illustrating an alignment of the casing and liner groove patterns differing from that shown in FIG. 4. FIG. 5(*b*) is a further representation showing said groove patterns.

FIG. 6 is a schematic representation of means for rotating a liner with respect to a warhead casing in response to a radio signal command in order to change the alignment of a liner groove pattern in relation to a casing groove pattern.

DESCRIPTION OF THE PREFERRED EMBODIMENT

Figure 7:
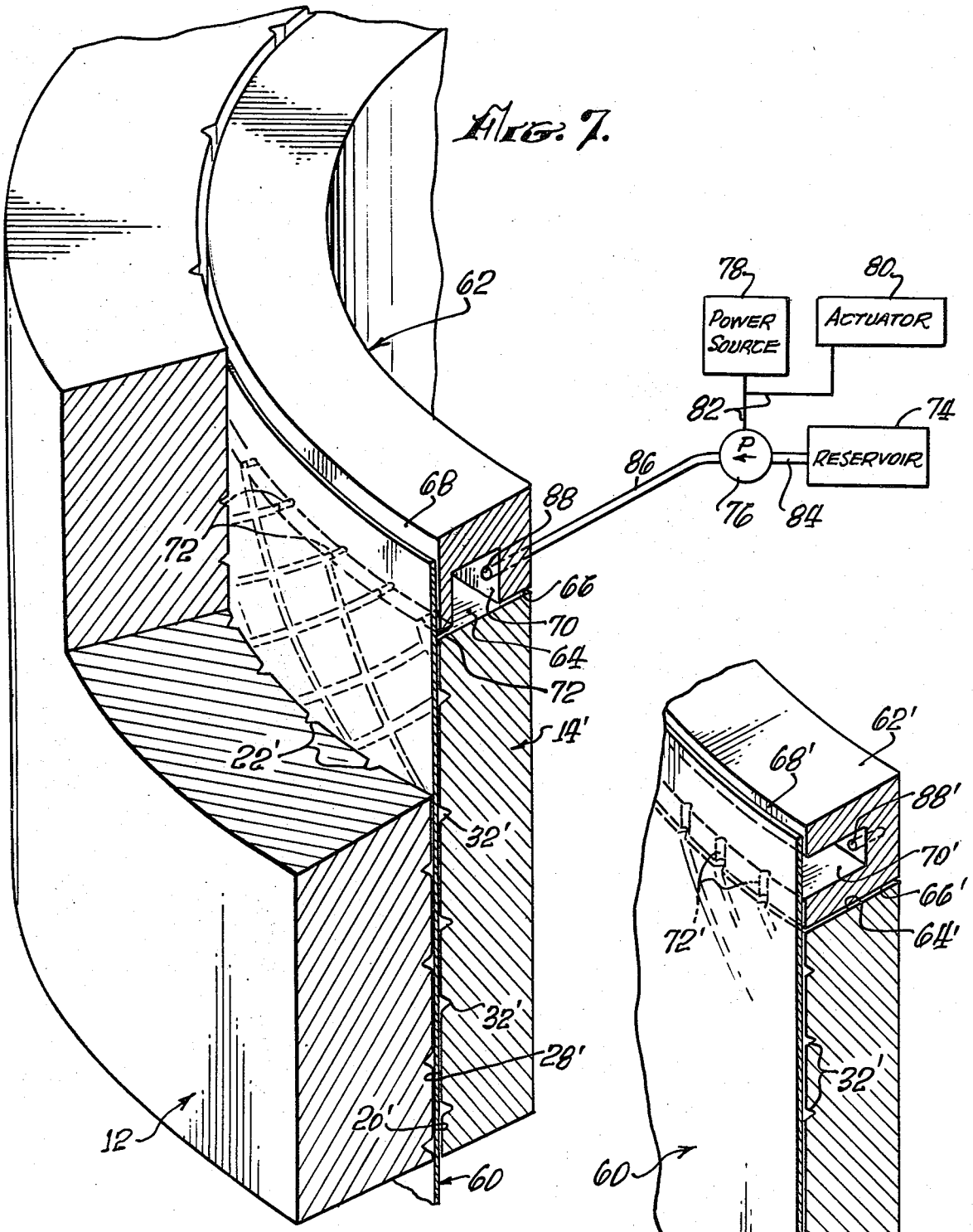
FIG. 7 is a combined sectioned, perspective view of a warhead embodying the invention described herein and a schematic diagram of means for delivering a fluid to the liner grooves.

In brief, this invention comprises inhibiting the cutting action of a grooved cutting component which may be a liner or explosive charge and which is positioned behind or interiorly of an internally or externally grooved warhead casing so that in the former case the grooves of the casing and cutting component are located in confronting surfaces. Inhibition is obtained by flowing a fluid into the grooves of the cutting component. In one embodiment the grooved pattern of the cutting component is fixed with respect to that of the casing, but in a second embodiment, the grooved pattern of the cutting component is movable with respect to the casing pattern.

Referring now to FIG. 1, the numeral 10 designates a warhead comprising a conical casing 12, a conical metal liner 14 disposed concentrically within the casing in axial alignment therewith, and an explosive charge 16 disposed within the liner. As is more clearly shown in FIG. 2, the casing 12 has an outer surface 18 and an inner surface 20 which is provided with a groove pattern comprising a plurality of intersecting grooves 22 which are positioned relative to each other to produce fragments of a desired, predetermined mass when the explosive charge 16 carried within the warhead is detonated. The grooves 22 are preferably V-shaped so that fragmentation of the casing 12 is initiated along the apex of each groove with the fragmenting forces travelling generally forwardly from the inner surface 20 to the outer surface 18 as shown by the dashed lines 24 in FIG.

2 to produce fragments such as that designated by the numeral 26 and having mass M.

As shown in both FIGS. 1 and 3, the liner 14 has an outer surface 28 and an inner surface 30. The outer surface 28 of the liner and the casing inner surface 20 are positioned so that they oppose or confront one another. The liner outer surface 28 is also provided with a groove pattern comprising a plurality of (preferably V-shaped) grooves or slots 32 arranged in intersecting relation to each other in a predetermined pattern. When the explosive charge 16 is detonated, the liner 14 is fragmented along the grooves 32 therein to provide a plurality of cutting edges around each liner fragment capable of penetrating and cutting the casing 12 into fragments the size of which will be comparable in cross-sectional area to, or smaller than, the individual areas bounded by the liner grooves depending upon the relative positions of the liner and casing groove patterns.

The liner groove pattern may be positioned with respect to the facing casing groove pattern so that the two patterns are congruent or so that they are not congruent, i.e., so that they do or do not exactly overlap, respectively. In one embodiment of this invention, the liner 14 is fixed with respect to the casing 12. In that embodiment, the casing and liner groove patterns are not congruent. Instead, the two groove patterns (which may or may not be identical to each other) are offset from each other as is shown for example, in FIG. 3 so that, if the cutting action of the liner is not inhibited as described hereinafter, the casing fragments will differ in size from the fragments produced when the liner cutting action is inhibited.

In FIG. 3, the casing and liner groove patterns are substantially identical, but are offset from each other by one-half the distance between adjacent casing grooves 22 as shown in FIG. 4 wherein the solid lines 34 represent the liner grooves 32 and the dashed lines 36 represent the casing grooves 22. If the cutting action of the liner 14 is not inhibited, detonation of the explosive charge 16 will cause the casing 12 to fragment and form fragments 38 (FIG. 3) of mass M/4. With inhibition of the liner 14, the casing fragments 26 would have a mass of M as previously noted. Similarly, if the liner 14 and casing 12 are indexed with respect to each other as shown by solid lines 40 and dashed lines 42, respectively, in FIG. 5(*a*), fragments 44 of varying sizes can be obtained by the cutting action of the liner 14 as shown in FIG. 5(*b*) (in contrast with fragments 46 obtained when the cutting action of the liner is completely inhibited). Thus, it will be apparent that, for any warhead, a selection can be made between large casing fragments (e.g., of mass M) and small casing fragments (e.g., of mass M/4), and that fragments of mixed sizes (exemplified by FIG. 5(*b*)) can be produced by appropriate offsetting or indexing of the casing and liner groove patterns with respect to each other.

In a second embodiment, the liner 14 is movable with respect to the casing 12 so that the relative positions of the groove patterns of the casing and liner can be altered. Therefore, the groove patterns of these two components can identically overlap initially. When it is determined which size of fragment is required, the liner 14 can be moved axially and/or azimuthally with respect to the casing 12 to provide the desired fragment size(s). Movement of the liner 14 with respect to the casing 12 can be performed by hand or by well-known means such as a mechanical gear linkage when on the ground, or by pneumatic hydraulic action using a gas generating squib actuated in flight by radio signals as shown schematically in FIG. 6.

In FIG. 6 a warhead (not shown) includes means 48 for receiving a radio signal and for actuating a piston in response thereto to cause rotation of a liner with respect to a warhead casing. More specifically, a radio signal carrying the appropriate command information is received by an antenna 49 and receiver 50 from which it (or a signal generated in response thereto) is conducted by electrical conductor 51 to a power supply 52. The latter is electrically connected to, and actuates, a gas generator 53 which, when activated, produces a gas which expands into a cylinder 54 where it exerts pressure against one face 55 of a piston 56 reciprocally carried therein. A piston rod 57 extending from an axially opposite face 58 of the piston 56 is positioned with respect to a liner 14 so that its leading end abuts against a step 59 formed in the liner when the piston is advanced by the generated gas pressure. Abutment of the piston rod 57 against the liner step 59 causes rotation of the liner to thereby bring the grooves formed in the latter into the desired alignment with respect to the grooves formed in the casing.

In order to inhibit the cutting action of the liner 14, the grooves 32 in the liner are filled with a fluid which will obstruct the potential cutting action of the liner. The fluid can be water or any other low viscosity fluid having a density close to that of water or higher, i.e., preferably between about 0.90 gm./cc. and about 1.5 gm./cc. For example, low viscosity oils such as silicone oils having low freezing points on the order of −40° C. and a density of about 0.9 gm./cc may be satisfactorily used. The fluid, of course, should be fluid at the temperatures within an operational warhead.

Thus far, there has been described a grooved casing/-liner arrangement in which the liner always functions to cut the casing in a predetermined way. In FIG. 7, there is shown a warhead (in partial section) embodying the improvement described herein for selectively inhibiting the cutting action of a liner by introducing (or not) a fluid capable of inhibiting the cutting action of a liner into the grooves formed in the latter.

As has been described hereinbefore, the warhead in FIG. 7 comprises a casing 12' and a liner 14' coaxially aligned with the casing with the confronting surfaces 20', 28' of the casing and liner, respectively, having grooves 22', 32', respectively, formed therein. The groove patterns in the casing 12' and liner 14' can be oriented with respect to each other as has been described in connection with FIG. 4 and FIG. 5(*a*). However, since the embodiment of FIG. 7 is designed to introduce a fluid into the grooves 32' in the liner 14' in order to provide selective inhibition of the cutting action of the latter, it includes a number of components not previously discussed as will now be described.

A liner cover 60 is inserted between the liner 14' and the casing 12' so that it abuts against the grooved surface 28' of the liner to function as a cover for the liner grooves 32' to prevent fluid in the latter from flowing out of the liner grooves in a radial direction toward the casing 12'. The liner cover 60 is shaped to substantially conform to the shape of the liner 14' and is sized to be at least coextensive in area with the area of the liner groove pattern.

A fluid manifold 62 for distributing fluid to the liner grooves 32' is disposed along rearwardly-facing end surface 64 of the liner 14' with a forwardly-facing first surface 66 of the manifold being in abutment with the liner end surface 64 so that the fluid manifold overlies the open ends of the liner grooves 32' and, except as described hereinafter, closes them off. A radially outwardly-facing second surface 68 of the fluid manifold 62 is substantially coplanar (in an arcuate sense) with the grooved surface 32' of the liner 14' so that those two surfaces 32', 68 are effectively continuities of each other. For a reason to become apparent hereinafter, the liner cover 60 is made to extend rearwardly in a longitudinal axis direction at least partially over the second manifold surface 68. The fluid manifold 62 itself is at least co-extensive with the distance along the edge of the liner end surface 64 over which the spaced grooves 32' extend through that surface so that fluid cannot escape rearwardly from the ends of those grooves 32' except as described hereinafter.

The fluid manifold 62 defines a fluid channel 70 which preferably opens through its first surface 66 and further defines at least one, but preferably a plurality of, radially-extending, transverse grooves 72 which are formed in the first surface 66 and which extend between the fluid channel and the manifold's second surface 68. The fluid manifold grooves 72 are spaced apart to locate opposite the ends of the liner grooves 32' so that they provide flow communication between the liner grooves 32' and the fluid channel 70. Because the liner cover 60 extends beyond the liner 14' in a longitudinal direction, it provides closure means closing off the radially outer ends of the manifold transverse grooves 72 at the manifold second surface 68 to thereby prevent fluid from escaping at the juncture of the manifold and liner grooves 72, 32'.

From the foregoing, it will be understood that fluid in the fluid manifold 62 is free to flow through the manifold grooves 72 into the liner grooves 32' to spread through the liner groove pattern. With the latter filled with fluid, the grooving of the liner 14' is rendered ineffective for cutting the casing 12'. In such case, the casing fragments are sized in accordance with the grooving of the casing 12'.

In order to force fluid into the fluid manifold 62, fluid delivery means are provided. Various well-known fluid delivery systems may be used. One such system includes a fluid reservoir 74, a pump 76, and power means including a power source 78 and an actuator 80 for receiving a signal and sending a corresponding command to the pump with such means operably connected to the pump through electric wires 82. Tubing 84 interconnects the reservoir 74 and the pump 76. Each of these components and their interconnection and operation are well known and will not be further described. In some applications, the pump 76 can be eliminated. In such a case, the spinning of the warhead 10 could be used to pump the fluid to the liner grooves 32' directly from the reservoir 74. The power means would then be used to open and close tubing 84 by actuating a valve (not shown) therein.

The pump 76 is flowably connected at its output end to another conduit 86 which, in turn, is slidably received by an aperture 88 defined by the fluid manifold 62 and extending to the fluid channel 70 so that communication is provided between the latter and the exterior of the fluid manifold. Fluid from the reservoir 74 can thus be pumped through conduits 84, 86 into the fluid manifold 62 for dispersal through the liner groove pattern.

Figure 8:
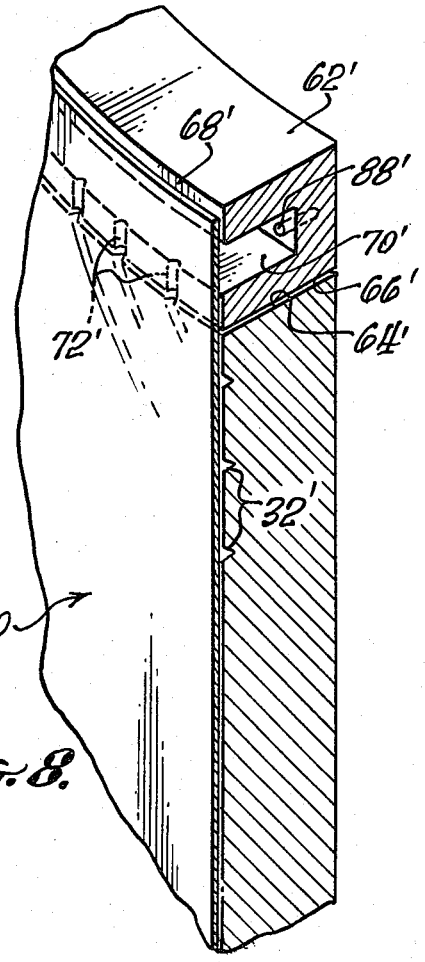
FIG. 8 is a partial section view of a liner and liner cover illustrating another embodiment of this invention.

Another manifold which may be used for delivering fluid to the liner grooves 32' is shown in FIG. 8. In that Figure, the manifold 62' is positioned so that the fluid channel 70' defined therein opens outward through the manifold second surface 68' toward the liner cover 60'. Manifold grooves 72' are formed in the second surface 68' between the fluid channel 70' and the first surface 66' which rests against the end surface 64' of the liner 32'. The liner cover 60' functions to close the fluid channel 70', manifold grooves 72', and liner grooves 32'. The fluid manifold 62' defines an aperture 88' which opens at one end into the fluid channel 70' so that a conduit inserted therein can deliver fluid to the fluid channel for distribution through the manifold grooves 72' to the liner grooves 32'.

In the foregoing description of the preferred embodiment, the warhead casing was described as being grooved along its interior surface. However, a groove pattern may be formed in its outer surface rather than in its inner surface with essentially the same results—although it may be less desireable to groove the outer surface from an aerodynamic standpoint.

The preferred embodiment has also been described using a metal liner as the cutting component although a grooved explosive charge could also serve that function as noted hereinbefore. When the explosive charge is grooved, it, of course, serves the dual functions of explosive and cutting element. Whether the described metal liner or explosive charge functions as the cutting element, the liner or fluid cover (which could serve the same function with respect to a grooved explosive charge) could be dispensed with, provided that an alternative surface, such as that provided by the casing, is placed in face-to-face abutting contact with the grooved surface of the cutting component to prevent loss of fluid from the groove pattern. Furthermore, the fluid manifold is not required to be coextensive with a surface defined by the ends of the groove pattern in the cutting component if one or more of such ends are otherwise closed off, e.g., by not extending any such groove to a rearward end surface (64) of a cutting component.

While it is desirable and preferable to form the liner from a metal (e.g., steel, copper, aluminum) as has been described, the liner may also be formed from other solid materials such as plastics and ceramics. A metal is preferred as the liner material since metal liner fragments have greater destructive potential than those made of plastics, etc. Similarly, the fluid cover may also be formed from a metal or plastic provided that any such material is impermeable to the particular fluid being used.

I claim:

1. In a warhead comprising a casing and a cutting component disposed interiorly of said casing with each of said casing and said cutting components defining groove patterns formed therein for fragmenting said casing in a predetermined manner upon detonation of an explosive carried within said warhead, the improvement which comprises:

a fluid capable of inhibiting the cutting action of said cutting component when flowed into said groove pattern therein;

a reservoir carried within said warhead for containing said fluid; and delivery means connected to said reservoir and communicating with said groove pattern in said cutting component for conducting said fluid from said reservoir to said cutting component groove pattern upon command.

2. The improvement of claim 1 wherein said fluid has a density between about 0.9 gm/cc and about 1.5 gm/cc.

3. The improvement of claim 2 wherein said fluid is a material selected from the group consisting of water and silicone oils having freezing points of about −40° C. and densities of about 0.9 gm/cc.

4. The improvement of claim 1 wherein said cutting component is a liner disposed between said casing and said explosive.

5. The improvement of claim 1 wherein said groove patterns are formed in confronting surfaces of said casing and said cutting component.

6. The improvement of claim 1 wherein said cutting component is said explosive.

7. The improvement of claim 1 wherein said warhead further includes rotational means for rotating said cutting component relative to said casing to change the relative alignment of said groove patterns in said casing and said cutting component.

8. In a warhead comprising a casing and a cutting component disposed interiorly of said casing with each of said casing and said cutting components defining groove patterns formed therein for fragmenting said casing in a predetermined manner upon detonation of an explosive carried within said warhead, the improvement which comprises:

a fluid capable of inhibiting the cutting action of said cutting component when flowed into said groove pattern therein;

a reservoir carried within said warhead for containing said fluid;

a fluid cover disposed between said casing and said cutting component in abutting contact with a confronting surface of said cutting component and overlying said groove pattern in said cutting component;

a fluid manifold carried within said warhead in cooperating relation with said fluid cover, said manifold defining at least one fluid passageway providing fluid communication between the interior of said manifold and said groove pattern in said cutting component, said fluid cover and said manifold cooperating to seal said groove pattern in said cutting component from loss of said fluid therefrom; and fluid delivery means connected to said reservoir and to said manifold for conducting fluid upon command from said reservoir to said groove pattern in said cutting component via said reservoir.

9. The improvement of claim 8 wherein said fluid has a density between about 0.9 gm/cc and about 1.5 gm/cc.

10. The improvement of claim 9 wherein said fluid is a material selected from the group consisting of water and silicone oils having freezing points of about −40° C. and densities of about 0.9 gm/cc.

11. The improvement of claim 8 wherein said cutting component is a liner disposed between said casing and said explosive.

12. The improvement of claim 8 wherein said cutting component is said explosive.

13. The improvement of claim 8 wherein said groove patterns are formed in facing surfaces of said casing and said cutting component.

14. The improvement of claim 8 wherein said warhead further includes rotational means for rotating said cutting component relative to said casing to change the relative alignment of said groove patterns in said casing and said cutting component.

15. The improvement of claim 14 wherein said rotational means comprises:

receiver means for receiving a command signal to rotate said cutting component;

power supply means electrically connected to said receiver means for acuating a gas generator connected to said power supply means to produce a gas;

cylinder means in communication with said gas generator for receiving said gas generated by said gas generator in one end thereof for urging a piston slidably carried in said cylinder means into abutting contact with said cutting component, whereby said cutting component is rotated in response to said command signal.

16. In a warhead comprising a casing defining a groove pattern formed in an interior surface thereof, an explosive charge carried within said casing, and a metal liner disposed between said casing and said explosive charge and defining a groove pattern in an outer surface thereof in facing relation with said groove pattern in said casing, the improvement which comprises:

a fluid capable of inhibiting the cutting action of said metal liner when flowed into said groove pattern therein, said fluid having a density between about 0.9 gm/cc and about 1.5 gm/cc;

a reservoir carried within said warhead for containing said fluid;

a liner cover disposed between said casing and said metal liner in abutting contact with a confronting surface of said metal liner and overlying said groove pattern in said metal liner;

a fluid manifold carried within said warhead in cooperating relation with said liner cover, said manifold defining at least one fluid passageway providing fluid communication between the interior of said manifold and said groove pattern in said metal liner, said liner cover and said manifold cooperating to seal said groove pattern in said metal liner from loss of said fluid therefrom; and fluid delivery means connected to said reservoir and to said manifold for conducting fluid upon command from said reservoir to said groove pattern in said metal liner via said reservoir.

* * * * *